US005847682A

United States Patent [19]

Ke

[11] Patent Number: 5,847,682

[45] Date of Patent: Dec. 8, 1998

[54] TOP LOADED TRIANGULAR PRINTED ANTENNA

[76] Inventor: Shyh-Yeong Ke, 29, Tong-Shin Road, Keelung, Taiwan

[21] Appl. No.: 710,332

[22] Filed: Sep. 16, 1996

[51] Int. Cl.[6] ..... H01Q 9/00; H01Q 1/38

[52] U.S. Cl. ..... 343/752; 343/700 MS; 343/846

[58] Field of Search ..... 343/702, 752, 343/700 MS, 795, 829, 830, 807, 846, 848

[56] References Cited

U.S. PATENT DOCUMENTS

| | | | |
|---|---|---|---|
| 3,967,276 | 6/1976 | Goubau | 343/752 |
| 4,012,741 | 3/1977 | Johnson | 343/700 MS |
| 4,520,363 | 5/1985 | Wachspress et al. | 343/828 |
| 4,737,797 | 4/1988 | Siwiak et al. | 343/821 |
| 4,816,839 | 3/1989 | Landt | 343/795 |
| 4,860,019 | 8/1989 | Jiang et al. | 343/795 |
| 5,181,044 | 1/1993 | Matsumoto et al. | 343/752 |
| 5,392,461 | 2/1995 | Yokoyama | 455/89 |
| 5,420,596 | 5/1995 | Burrell et al. | 343/700 MS |
| 5,479,178 | 12/1995 | Ha | 343/702 |
| 5,706,016 | 1/1998 | Harrison, II | 343/752 |

OTHER PUBLICATIONS

Lebbar, H. and others: Analysis and size reduction of various printed monopoles with different shapes; in: Electronics Letters, Oct. 13, 1994, vol. 30, No. 21, pp. 1725 to 1726.

*Primary Examiner*—Don Wong
*Assistant Examiner*—Tan Ho
*Attorney, Agent, or Firm*—Proskauer Rose LLP

[57] ABSTRACT

A top loaded antenna is provided that is composed of a triangular-shaped resonator and a dielectric substrate. The triangular-shaped resonator is located on a first plane with its top connected a vertical rectangular strip and its bottom connected to a microstrip feed line through a smooth tapering strip. There is one grounded strip on both sides of the smooth tapering strip in parallel to the rectangular strip load, where each grounded strip is connected to a grounded metallic plate on a second plane through a plurality of via holes. The present invention utilizes the top loading technique and the smooth tapering technique to create the design of a compact and built-in antenna which will provide a planar antenna structure with broad bandwidth and high radiation efficiency. The inventive antenna has a very even radiation field on the horizontal plane and is thus ideal for the radio transceiver used in mobile communications.

10 Claims, 9 Drawing Sheets

| MARKER 1 | MARKER 2 | MARKER 3 | MARKER 4 | ▷ MARKER 5 |
|---|---|---|---|---|
| 1.763 GHz | 1.88 GHz | 1.89 GHz | 1.9 GHz | 1.963 GHz |
| 1.9985 | 1.0622 | 1.1153 | 1.2086 | 2.0029 |

| MARKER 1 | MARKER 2 | ▷ MARKER 3 | MARKER 4 | MARKER 5 |
|---|---|---|---|---|
| 1.8142 GHz | 1.88 GHz | 1.89 GHz | 1.9 GHz | 1.948 GHz |
| 2.0303 | 1.1345 | 1.1581 | 1.2395 | 2.0021 |

TOP LOADED TRIANGULAR PRINTED ANTENNA

RELATED APPLICATION

U.S. patent application Ser. No. 08/578,881, entitled "Non-Coplanar, Resonant Element, Printed Circuit Board Antenna," was filed on Dec. 22, 1995 for Chewnpu Jou now pending and U.S. application Ser. No. 08/611,948, entitled "Omni-Directional Horizontally Polarized Alford Loop Strip Antenna", was filed on Mar. 7, 1996 for Huey-Ru Chuang et al now U.S. Pat. No. 5,767,809. The above-noted applications are assigned to the assignee of this application. The contents of the above-noted applications are relevant to the subject matter of this application and are fully incorporated herein by reference.

FIELD OF THE INVENTION

The present invention relates generally to an antenna structure, and, more particularly, to a planar antenna for receiving and transmitting electric signals in a personal portable communications device, such as in a cellular telephone, and in a printed antenna required by a card radio-frequency circuit board in all communications equipment.

BACKGROUND OF THE INVENTION

Due to the progress in the integrated circuit technology, wireless mobile communications equipment has continued developing towards lighter weights and smaller sizes so that the user can further enjoy the convenience provided by devices such as cellular telephones.

With respect to personal portable communications devices, it is desirable that such devices be capable of radiating omni-directional signals in the horizontal plane. In the early stages of development of wireless mobile communications devices, wire antennas such as the whip antenna and the monopole antenna were used which normally required that the antenna be installed outside of the case of the communication transceiver. This is very inconvenient as it is troublesome for the user to carry it around as a personal mobile communications device. In addition, the wire antenna is assembled manually and therefore lacks a reliable reproducibility and suffers from a high labor cost. Recent development in the wire antenna includes a combination collapsible rod and helical antenna, as illustrated in U.S. Pat. No. 5,479,178 entitled "Portable Radio Antenna" (FIG. 1). FIG. 1 shows a portable radio apparatus 10 having a collapsible rod antenna 14 and a helical antenna 16 fixedly attached to the top portion of housing 12. Housing 12 includes a printed board 18 having a matching circuit, duplicator, transmitter and receiver.

This antenna structure has resulted in greater portability, thus greater convenience to the user, than the conventional wire antenna. When the telephone is not being used, the user can collapse the antenna into the device and rely on the helical antenna; however, alone the helical antenna has poor radiation efficiency with respect to receiving the electromagnetic wave signals. Therefore, when the user operates the portable telephone, the collapsible antenna is pulled out to transmit or receive the electromagnetic wave signals, which creates an inconvenience to the user's operation.

In addition, the conventional technology has developed the L-shaped antenna that can be used in a portable radio telephone, as described in, e.g., U.S. Pat. No. 5,392,461 entitled "Portable Radio Communication Apparatus Unnecessitating Shielding Case" (FIG. 2). Specifically, FIG. 2 shows a portable radio communication apparatus 20 having a printed circuit board 22 fixedly attached to a housing 26. L-shaped antenna 24 and electronic parts 28 are mounted on circuit board 22.

This type of antenna is built inside the case so that it will not affect the user in terms of portability and operation. Nevertheless, since it is mainly assembled manually, the reliability in the reproduction of the antenna is reduced. Furthermore, although the L-shaped antenna structure is grounded directly, the antenna efficiency is reduced.

In an effort to improve the gain (or efficiency) of the antenna, the structure of a top loaded antenna has been introduced. U.S. Pat. No. 5,181,044 entitled "Top Loaded Antenna" provides an example, as illustrated in FIG. 3. FIG. 3 shows top loaded antenna 30 comprising a top load plate 32 coupled to a ground plate 34 via matching element 38. Matching element 38 is also coupled to antenna cable 36.

As described in *Antenna Theory and Design* by W. L. Stutzman and G. A. Thiele, Ch. 2, (1981), top loaded dipole antennas (such as top loaded antenna 30) will increase the radiation resistance by three times without affecting the original radiation field. This occurs since the symmetry of the top loaded structure offsets the far field radiation. However, the antenna of FIG. 3 is relatively large and is therefore not a good alternative in, e.g., cellular phones.

Accordingly, as the current trend continues in reducing the size of mobile communications devices, a greater effort on the part of engineers to develop ever smaller built-in antennas has heightened, to provide improved portability and operation to the user of mobile communications devices. However, as the antenna become smaller, the bandwidth and the radiation efficiency of the antenna will decrease, presenting a greater challenge to the antenna designers. On the one hand, a broad bandwidth antenna is necessary to meet the requirements of multi-channel telephone systems. Moreover, a broad bandwidth prevents the frequency drift effect that may be caused by the close proximity between the human body and the communications transceiver and increases the error tolerance in the manufacture process. On the other hand, for optimal transmission and reception of electromagnetic signals, the radiation field of the antenna should be omni-directional, while the gain of the antenna must be maximized to improve the reception sensitivity of the attached communications transceiver.

In an attempt to meet the above requirements, printed circuit antennas have become the subject of much research in connection with the design of small, built-in antennas. For example, U.S. Pat. No. 4,737,797 entitled "Microstrip Balun-Antenna Apparatus" discloses a balun (butterfly) planar antenna, as shown in FIG. 4. In FIG. 4, a butterfly planar antenna apparatus 40 includes a butterfly microstrip and a balun input strip transmission line 46, printed respectively on the two sides of the integrated circuit board 48 using a conventional printed circuit process. The transmission line 46 is coupled to butterfly antenna 42 via balancing section 44. The operating center frequency of this antenna is 1.7 GHz and the length of the rectangular loop of its balun circuit is 1.7 cm. If the additional length of the balun input strip transmission line is taken into account, the size of the antenna is still too large for a small communications transceiver, such as a mobile telephone.

It is therefore an object of the present invention to overcome the disadvantages of the prior art.

SUMMARY OF THE INVENTION

This and other objects are achieved by the present invention. According to one embodiment, an antenna is provided including a triangular-shaped resonant element positioned in a first plane. A tapered strip section is connected at the bottom position of the resonant element at the end of two diagonal side edges. A microstrip input transmission line is connected to the tapered section, while a vertical rectangular strip load is connected to the top vertical section of the resonant element.

As a further aspect of this embodiment, the antenna further includes a pair of grounded strip sections, positioned in the first plane and in parallel to the rectangular strip load, that are each connected to a grounded metallic surface in a second plane through a plurality of via holes.

In another embodiment of this invention, the antenna further includes a pair of first grounded strip sections, positioned in the first plane and in parallel to the rectangular strip load, that are each connected to a grounded metallic surface in a second plane through a plurality of corresponding via holes in the first grounded strip sections and the metallic surface. A second grounded strip section is positioned in a third plane and is located directly under and in parallel to the first grounded strip sections in the first plane. The second grounded strip section is connected to the grounded metallic surface in the second plane through a plurality of corresponding via holes in the second grounded strip section and the grounded metallic surface.

The planar antenna structure disclosed in the embodiments of the present invention can be manufactured through the printed circuit process on the card radio frequency substrate used in the mobile communications devices, and it has such advantages as low cost, small size, lightweight, reliable reproducibility and robust architecture that it will meet the requirements of today's mobile communications equipments.

The planar antenna of the present invention has a center operating frequency of approximately 1.89 GHz. The height of the printed circuit supporting the antenna is only about 1.09 cm. In addition, although the size of the antenna is small, the antenna gain can still be as high as 2 dBi. By comparison, the antenna gain for the so-called short dipole antenna is 1.76 dBi.

In summary, the present invention describes an antenna with a broad bandwidth capable of radiating signals omnidirectionally. The inventive antenna utilizes the top loading and smooth tapering techniques to achieve a compact and built-in design for the antenna.

BRIEF DESCRIPTION OF THE DRAWINGS

The following detailed description, giving by way of example and not intended to limit the present invention solely thereto, will best be understood in conjunction with the accompanying drawings in which.

DETAILED DESCRIPTION OF THE INVENTION

Figure 1:
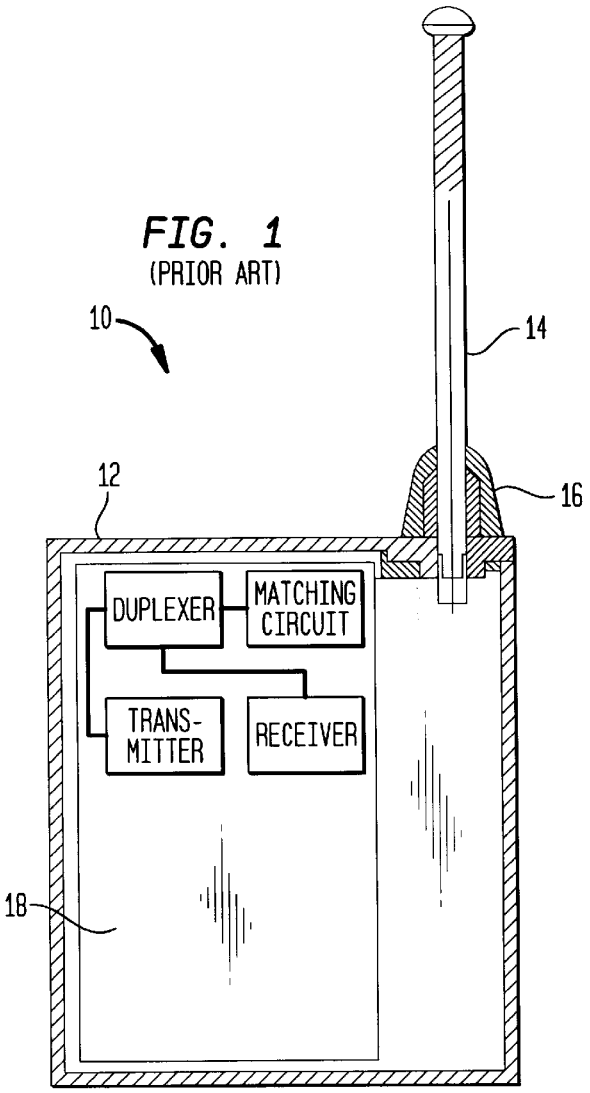
FIG. 1 (PRIOR ART)
FIG. 1 shows a conventional collapsible rod antenna in a portable radio device.
Figure 2:
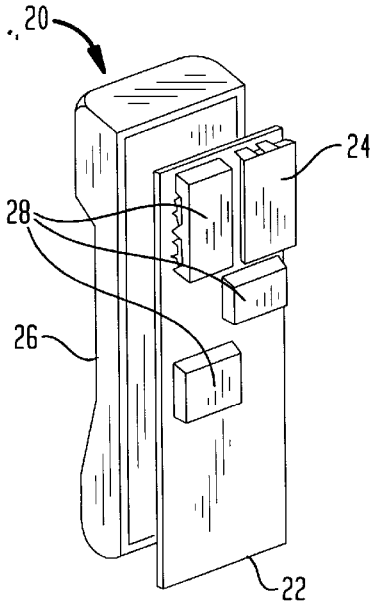
FIG. 2 (PRIOR ART)
FIG. 2 shows a conventional L-shaped antenna in a portable radio device.
Figure 3:
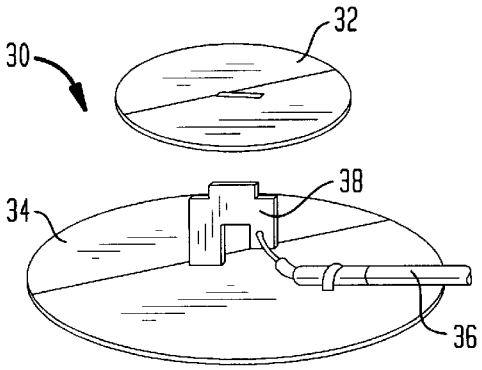
FIG. 3 (PRIOR ART)
FIG. 3 shows a conventional top loaded antenna.
Figure 4:
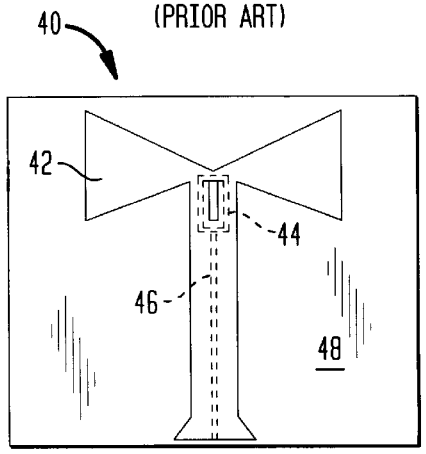
FIG. 4 (PRIOR ART)
FIG. 4 shows a conventional balun butterfly planar antenna.
Figure 5A:
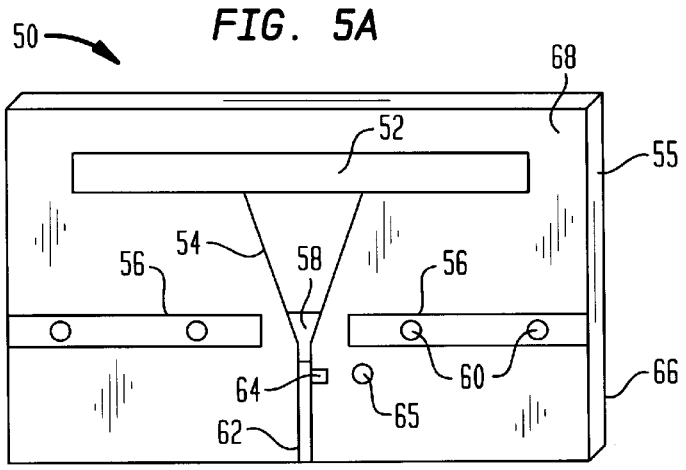
FIG. 5A shows a top perspective view of the triangular-shaped antenna having first and second planes in accordance with a first embodiment of the present invention.
Figure 5B:
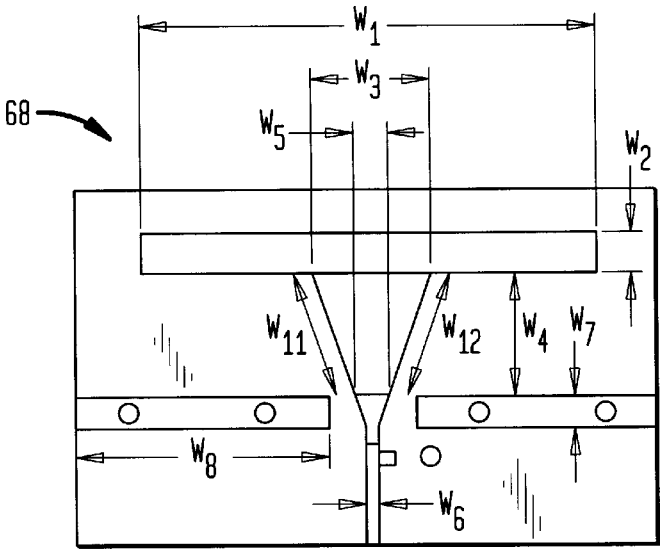
FIG. 5B shows a plan view of the first plane of the antenna of FIG. 5A.
Figure 5C:
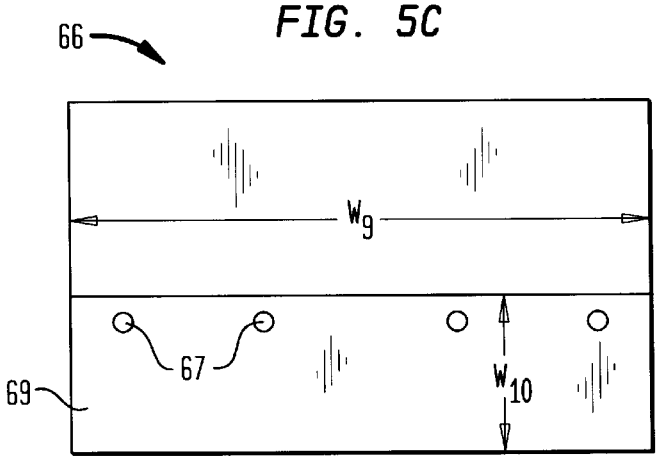
FIG. 5C shows a plan view of the second plane of the antenna of FIG. 5A.

FIGS. 5A–5C show an antenna structure 50 mounted on a printed circuit board according to one embodiment of the present invention. Antenna structure 50 has a vertical rectangular load 52, a triangular-shaped resonator 54 having a smooth tapered section 58, a pair of grounded strips 56, a microstrip input transmission line 62, a grounding surface 69 and a dielectric medium 55. Preferably, grounded strips 56, grounding surface 69 and rectangular load 52 are metallic strip conductors printed on different planes of dielectric medium 55 of the printed circuit board.

As shown in FIG. 5B, triangular-shaped resonator 54 is located in a first plane 68 with its top vertical side connected symmetrically with, and in parallel to, the bottom line of rectangular strip load 52. The bottom of the triangular-shaped antenna is connected to microstrip transmission line 62 via tapered strip section 58. To facilitate the connection between the triangular-shaped resonator and the tapered strip section, the position where the resonator's two diagonal side edges meet may be a short vertical line, parallel to the top vertical side of the resonator. Accordingly, the triangular-shaped resonator may have, in reality, a trapezoidal shape.

The two grounded strips 56 are also located in first plane 68 and are in parallel to the rectangular strip load and symmetrically positioned perpendicularly on the two sides of microstrip transmission line 62. Grounded strips 56 have a plurality of via holes 60 which connect first plane 68 to the corresponding via holes 67 of the grounding surface 69 in a second plane 66 (FIG. 5C) through respective cylinder conductors (not shown).

At the point where tapered section 58 is connected with microstrip transmission line 62, there is a rectangular stub 64 which is connected with grounded via hole 65, on the right side of the microstrip transmission line, to ensure a proper impedance matching for the antenna. In addition, dielectric medium 55, i.e. the radio-frequency substrate, is located between first and second planes 68, 66, as the support board and fixture for the rectangular load, the triangular-shaped resonator, the tapered section, the microstrip transmission line and the grounded strips in the first plane and for the grounded surface in the second plane.

The antenna structure 50 can be manufactured using a conventional printed circuit process so that it can be made intricate to a radio-frequency circuit layout with ease and precision.

FIGS. 6A–6D show an antenna structure 70 mounted on a circuit board and partially encased in first and second electromagnetic shielding covers in accordance with another embodiment of the present invention. Antenna structure 70 includes a vertical rectangular load 72, a triangular-shaped resonator 74, first and second grounded strip sections 86, 122, a microstrip input transmission line 82, electromagnetic shielding covers 88, 89 and multiple layers of dielectric substrates (radio-frequency substrates) 83. As with FIGS. 5A–5C, first and second grounded strips 86, 122, grounding surface 119 and rectangular load 72 are preferably metallic strip conductors printed on different planes of the multilayer dielectric of the printed circuit board.

Figure 6A:
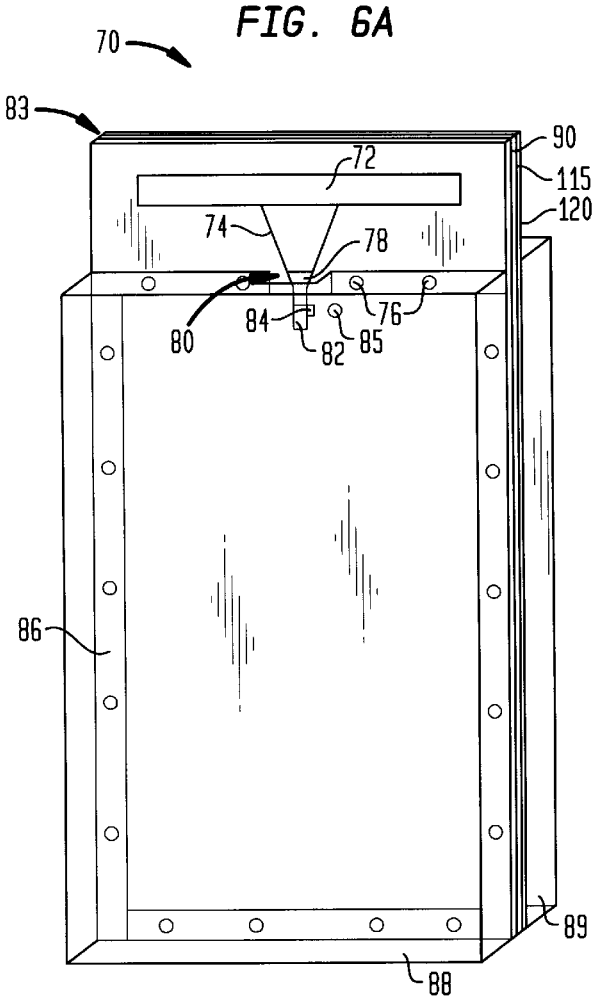
FIG. 6A shows a top perspective view of the triangular-shaped antenna in an electromagnetic shielding cover having first, second and third planes in accordance with a second embodiment of the present invention.
Figure 6B:
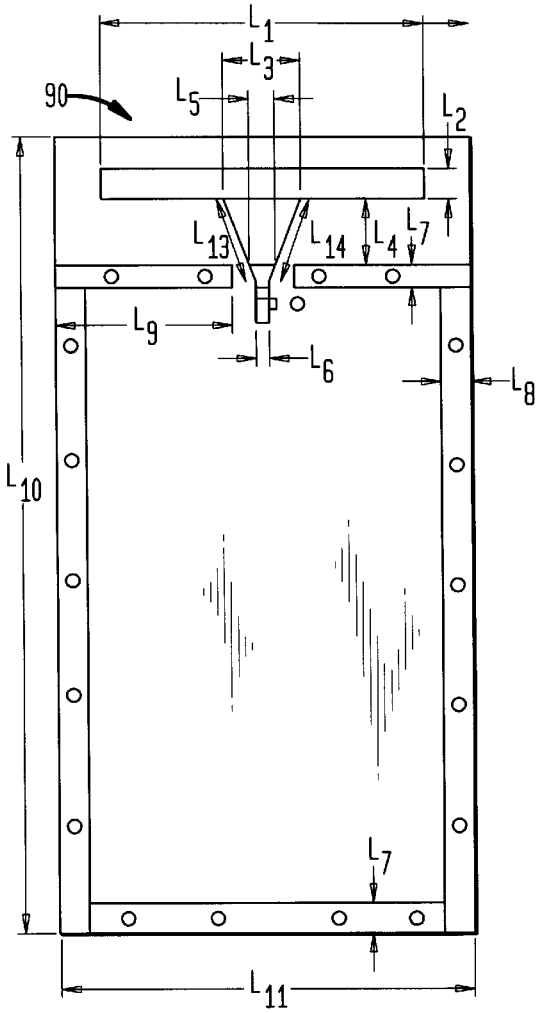
FIG. 6B shows a plan view of the first plane of the antenna of FIG. 6A.
Figure 6C:
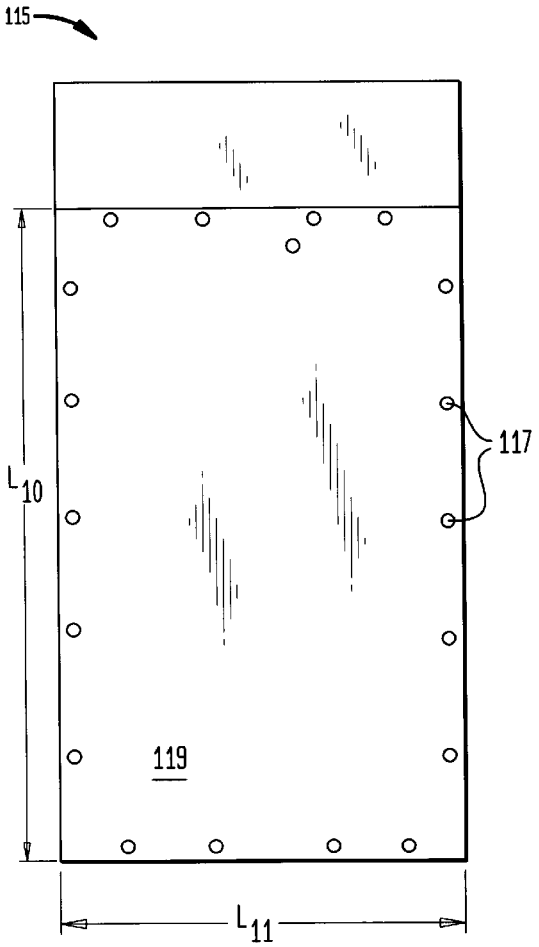
FIG. 6C shows a plan view of the second plane of the antenna of FIG. 6A.
Figure 6D:
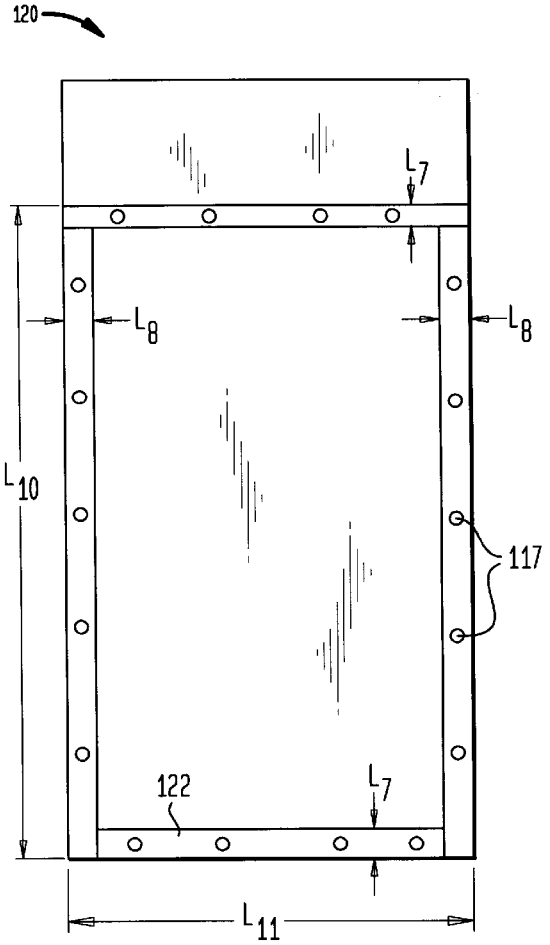
FIG. 6D shows a plan view of the third plane of the antenna of FIG. 6A.

As shown in FIG. 6B, triangular-shaped resonator 74 (which is essentially similar to triangular-shaped resonator 54) is located in a first plane 90 with its top vertical side connected symmetrically with, and in parallel to, the bottom line of rectangular strip load 72. The bottom of the triangular-shaped antenna is connected to microstrip transmission line 82 via smooth tapered strip section 78. Perpendicular to tapered section 78 is rectangularly-shaped first grounded strip section 86 that extends to the edge of the first plane 90 of multilayer dielectric 83, as shown in FIG. 6B. Rectangularly-shaped second grounded strip section 122, located in third plane 120, is positioned directly under, and in parallel to, first grounded strip section 86. Structurally, second grounded strip section 122 forms an unbroken rectangle, whereas first grounded strip section 86 is broken, so that tapered section 78 can lie between the break.

Via holes in first and second grounded strip sections 86, 122, are connected to corresponding via holes 117 on grounding surface 119 located in a second plane 115 (FIG. 6C) through respective cylinder conductors (not shown). First grounded strip section 86, located in first plane 90, functions as the grounding platform for the first electromagnetic shielding cover 88; similarly, second grounded strip section 122, located in third plane 120, functions as the grounding platform for the second electromagnetic shielding cover. The electromagnetic shielding covers are used not only as a resistance of electromagnetic coupling between the antenna and the radio-frequency circuit, but is also used as the grounding surface for the antenna structure as a whole.

In addition, there is a rectangular hole 80 in the top surface of the first electromagnetic shielding cover through which microstrip transmission line 82 is connected to tapered strip section 78. At the point where tapered strip section 78 is connected with microstrip transmission line 82, there is a rectangular stub 84 which is connected with grounded via hole 85, on the right side of the microstrip transmission line, to ensure a proper impedance match for the antenna.

Multiple layer dielectric medium 83 is located in between the first, second and third planes, 90, 115, 120, as the support board and fixture for the rectangular load, the triangular-shaped resonator, the tapered section, the microstrip transmission line and the first grounded strip section in the first plane, for the grounded surface in the second plane, and for the second grounded strip section in the third plane.

In general, the size of antenna 70 depends on the selected operating frequency of the antenna. Specifically, the lower the height of the triangular-shaped resonator 54, 74, the smaller the area of the printed circuit board that will be used by the antenna. Further, the slope of the two sides of the triangular-shaped resonator and the length of the top vertical section will decide the radiation field of the antenna. Additionally, the size of the rectangular strip load will affect the operating frequency of the antenna, the input impedance, the radiation efficiency (antenna gain), and the operating bandwidth. Also, the geometric structure of the tapered strip section and the triangular-shaped will increase the operating bandwidth of the antenna.

The following discussion will focus on the electromagnetic properties of the inventive structure of the antennas, shown in FIGS. 5 and 6, as illustrated in the following experiments. The dielectric medium used in the experiments was "FR4" fiberglass, which is extensively utilized in the industry, and has a relative dielectric parameter within the range of 4.2–4.7. The impedance of the electric power selected for the tests was 50 ohms. Further, the antenna structures in both FIGS. 5 and 6 were connected in parallel with an inductance of 2.2 nH as the impedance match.

Experiment 1

The structure of the antenna as shown in FIGS. 5A–5C (without the electromagnetic shielding cover):

Thickness of the dielectric substrate=0.12 cm,

Area of the dielectric substrate=4.5 cm×2.31 cm, $W_1$=3.32 cm, $W_2$=0.38 cm, $W_3$=$W_4$=0.81 cm, $W_5$=0.15 cm, $W_6$=0.08 cm, $W_7$=0.20 cm, $W_8$=2.05 cm, $W_9$=4.5 cm, $W_{10}$=$W_{11}$=$W_{12}$=0.87 cm.

Figure 7:
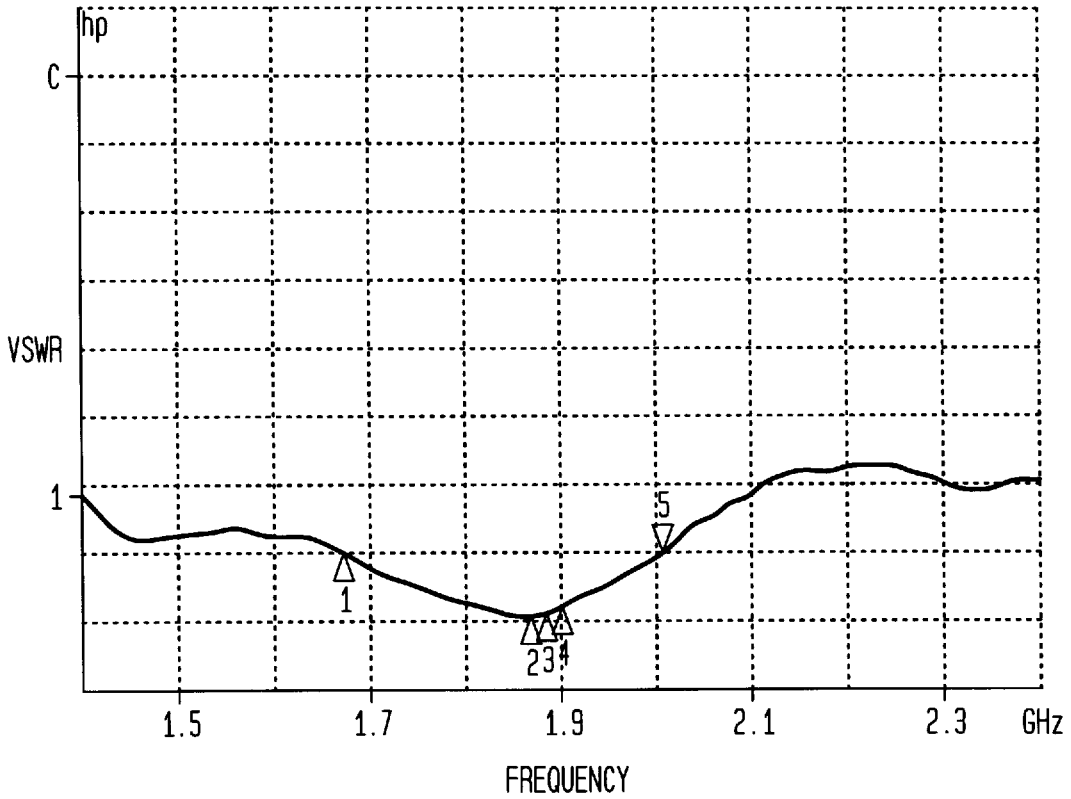
FIG. 7 shows the variation of the voltage standing wave ratio of the antenna of FIG. 5 with frequency.
Figure 8A:
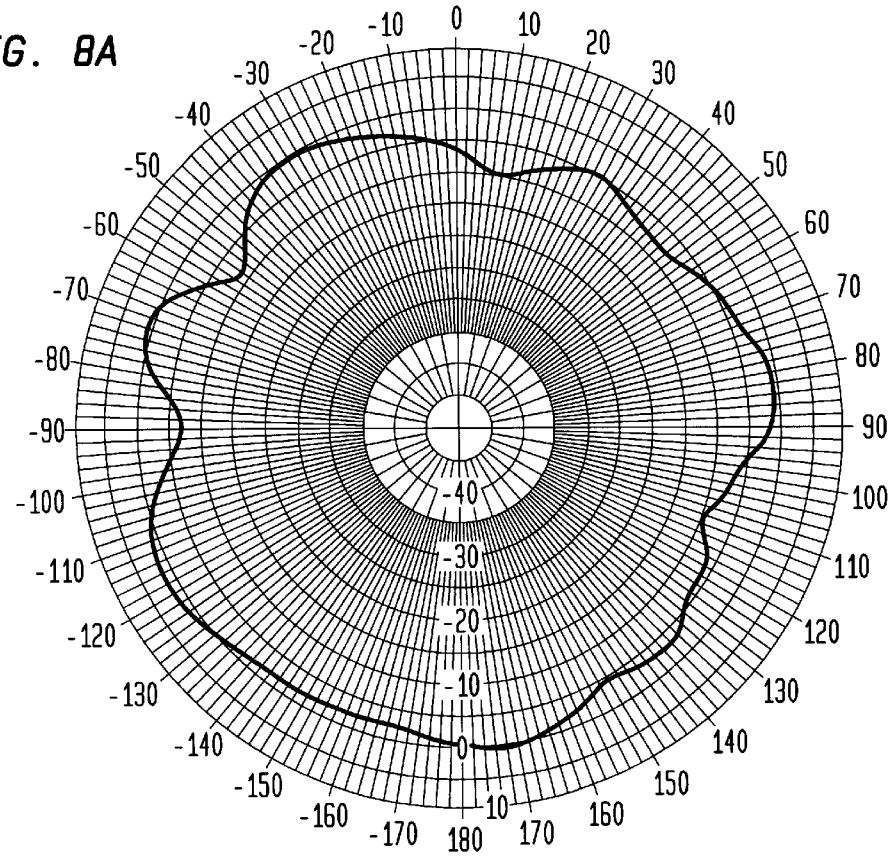
FIGS. 8A, 8B and 8C show X—Y plane, Y—Z plane and X—Z plane radiation patterns of the antenna of FIG. 5.
Figure 8B:
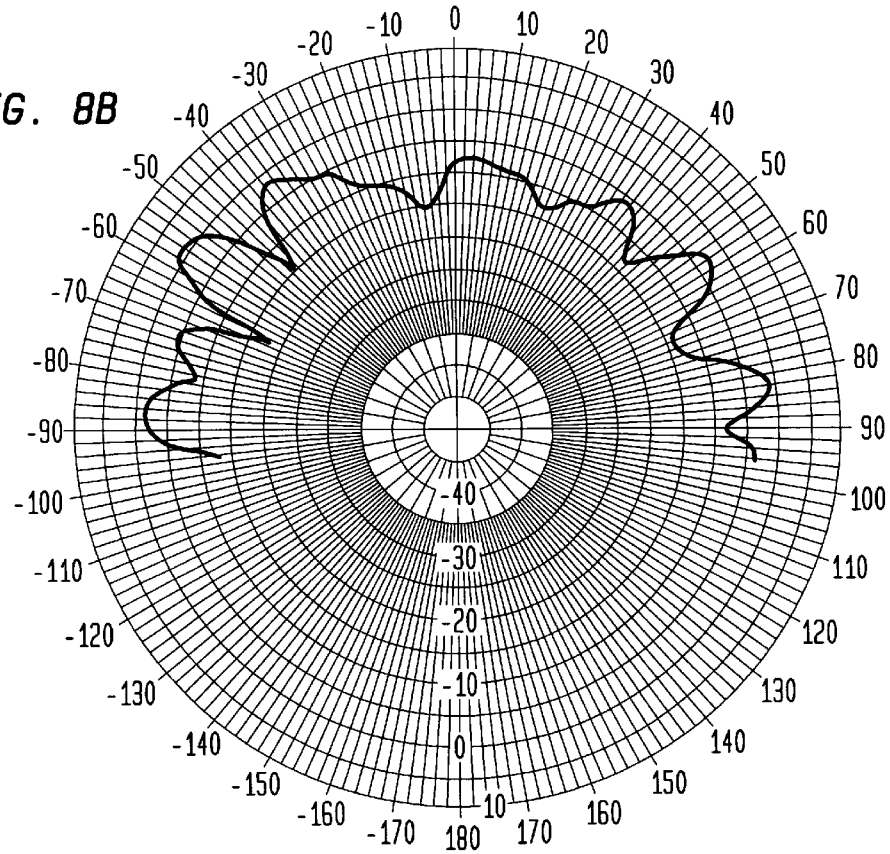
Figure 8C:
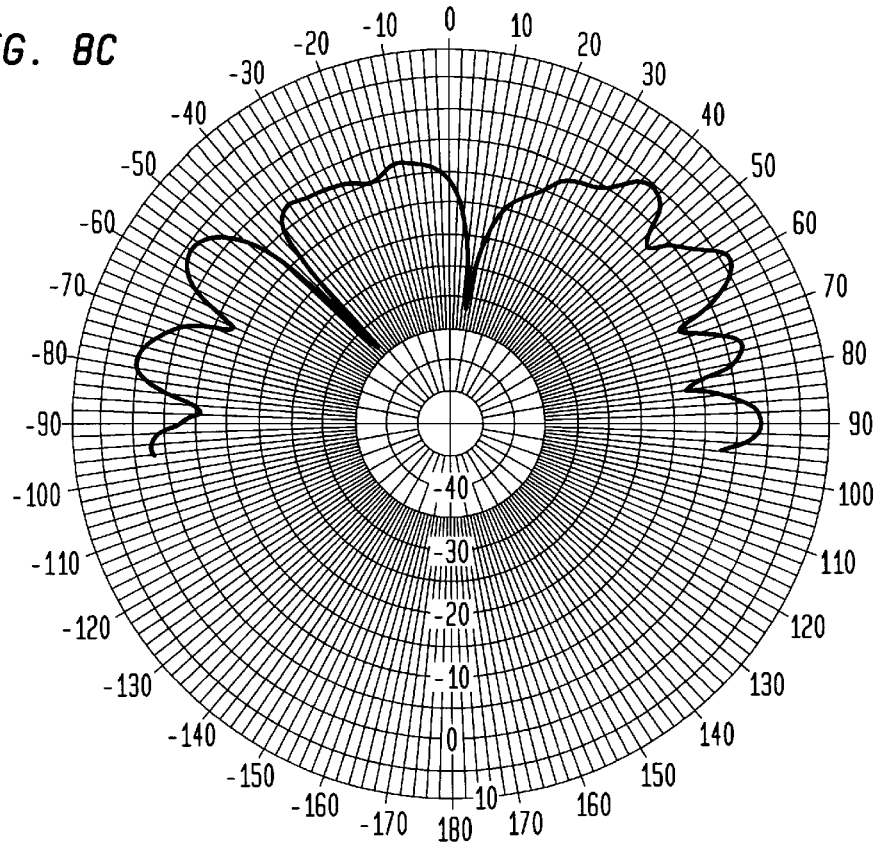

FIG. 7 illustrates the test results of the input voltage standing wave ratio (VSWR) of the antenna in FIG. 5 in relation to the changes in frequency, wherein the operating frequency bandwidth is 11% (which qualifies antenna structure 50 as a broad bandwidth antenna structure). In general, the bandwidth range of an antenna is typically defined as VSWR≦2. The medium operating frequency was chosen at 1.89 GHz which is the center frequency of the 1.88 GHz to 1.9 GHz frequency range for the DECT (Digital European Cordless Telephone) digital telephone frequency. The radiation field patterns of the antenna of FIG. 5 in the x—y plane, the x—z plane and the x—z plane, are shown in FIGS. 8A, 8B and 8C, respectively. As indicated in FIGS. 8A–8C, antenna structure 50 radiates an electromagnetic signal fairly omni-directionally. For example, it can be observed from FIG. 8A that the radiation field on the x—y plane (the horizontal plane) is very even and the antenna peak gain is measured at 2.62 dBi.

Experiment 2

The structure of the antenna as shown in FIGS. 6A–6D (with the electromagnetic shielding cover):

Thickness of the dielectric substrate=0.04 cm (total of three substrates=0.12 cm), Area of the dielectric substrate=4.5 cm×9.4 cm, Size of the electromagnetic shielding cover=4.5 cm×8 cm×0.5 cm, $L_1$=3.12 cm, $L_2$=0.35 cm, $L_3$=$L_4$=0.74 cm, $L_5$=0.15 cm, $L_6$=0.08 cm, $L_7$=$L_8$=0.20 cm, $L_9$=2.05 cm, $L_{10}$=$L_{11}$=8.0 cm, $L_{12}$=4.5 cm, $L_{13}$=$L_{14}$=0.80 cm.

Figure 9:
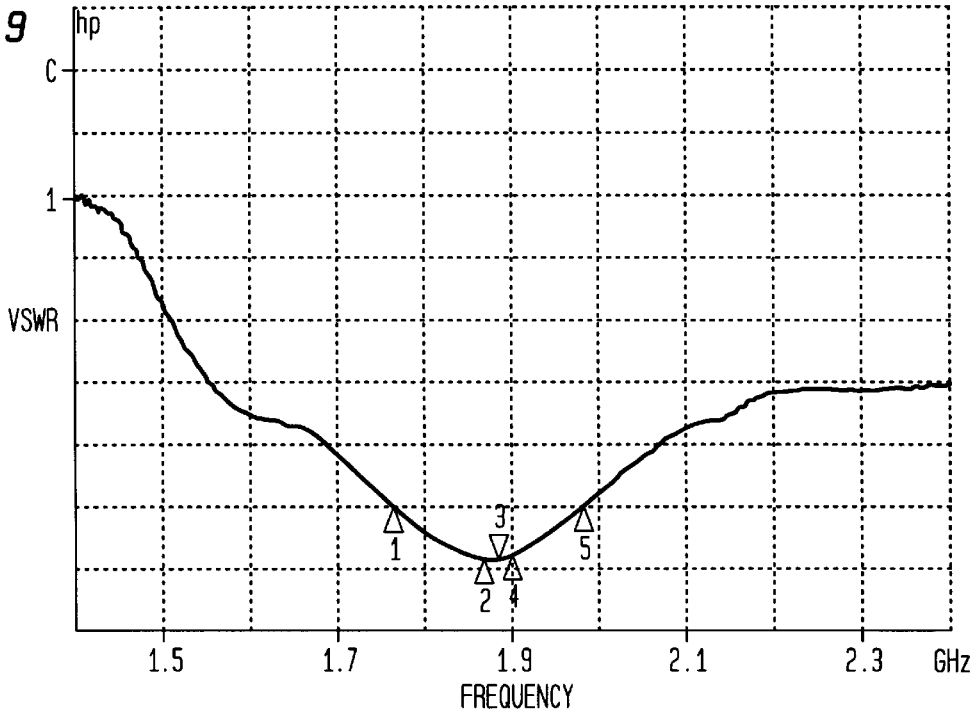
FIG. 9 shows the variation of the voltage standing wave ratio of the antenna of FIG. 6 with frequency.
Figure 10A:
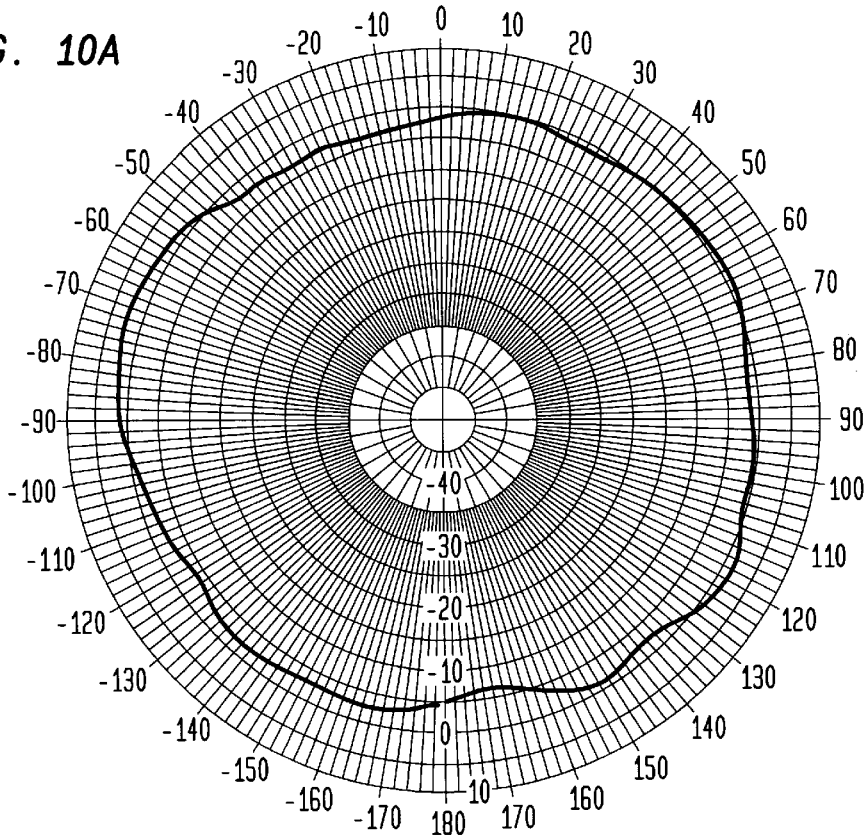
FIGS. 10A, 10B and 10C show X—Y plane, Y—Z plane and X—Z plane radiation patterns of the antenna of FIG. 6.
Figure 10B:
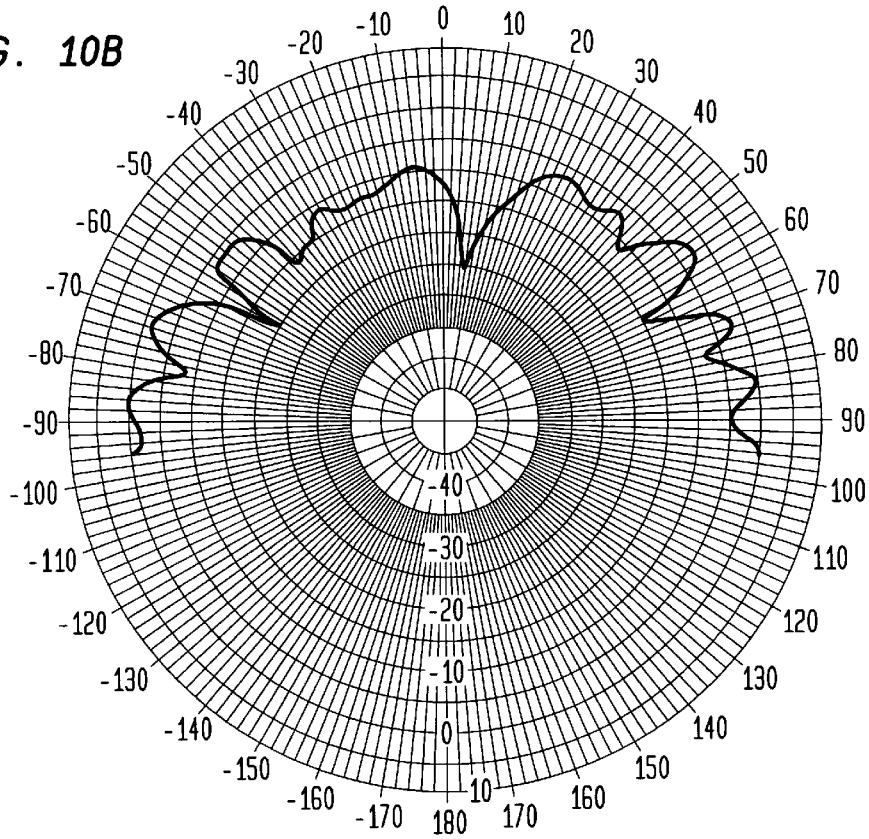
Figure 10C:
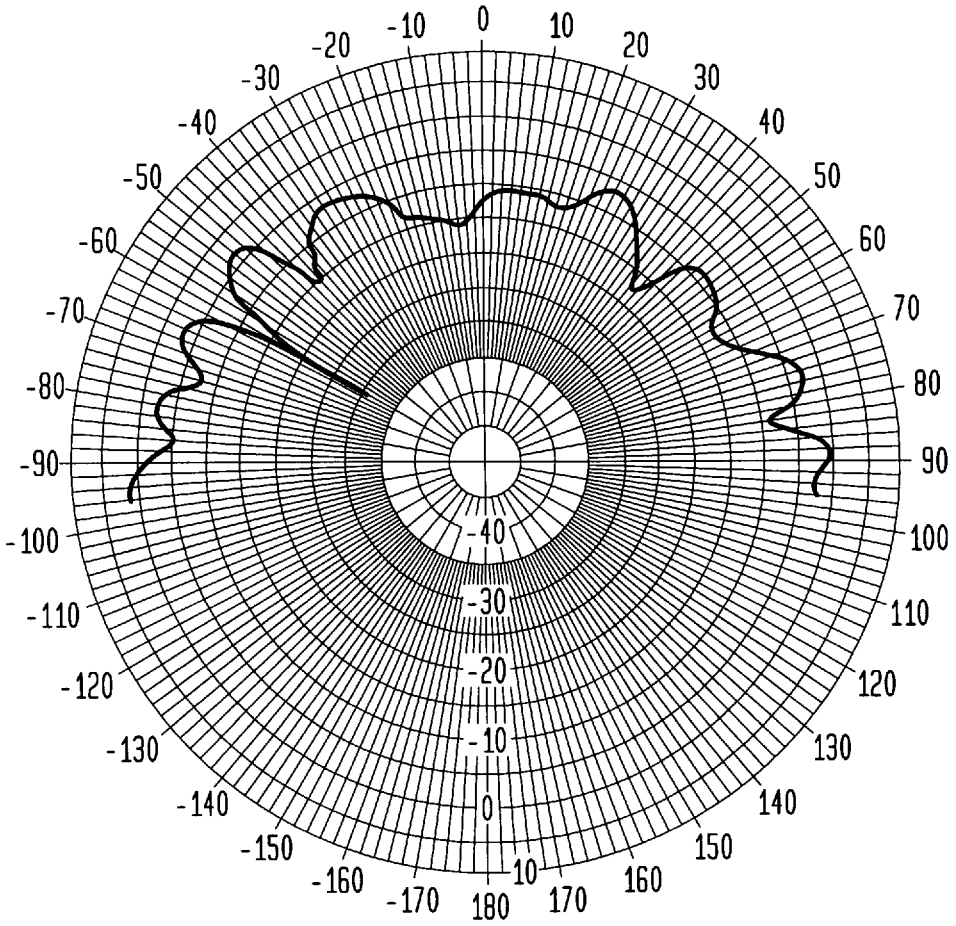

FIG. 9 illustrates the test results of the input voltage standing wave ratio (VSWR) of the antenna in FIG. 6 in relation to the changes in frequency, wherein the operating frequency bandwidth is 7%. Similarly to FIG. 7, the medium operating frequency was chosen at 1.89 GHz which is the center frequency of the 1.88 GHz to 1.9 GHz frequency range for the DECT digital telephone frequency. The radiation field patterns of the antenna of FIG. 6 in the x—y plane, the x—z plane and the x—z plane, are shown in FIGS. 10A, 10B and 10C, respectively. As indicated in FIGS. 10A–10C, antenna structure 50 radiates an electromagnetic signal fairly omni-directionally. Further, it can be observed from FIG. 10A that the radiation field on the x—y plane (the horizontal plane) is very even and the antenna peak gain is measured at 2.0 dBi.

While several embodiments have been chosen to illustrate the invention, it will be understood by those skilled in the art that various changes and modifications can be made herein without departing from the scope or spirit of the invention as defined in the appended claims.

The claimed invention is:

1. An antenna comprising:

a triangular-shaped resonant element, disposed in a first plane, having a top side and two diagonal sides meeting at a bottom;

a tapered strip section connected at said bottom between said two diagonal sides;

a microstrip input transmission line connected to said tapered strip section;

a rectangular strip load connected to the top side of said triangular-shaped resonant element;

a pair of first arounded strip sections, disposed in said first plane and in parallel to said rectangular strip load, each connected to a grounded surface in a second plane through a plurality of corresponding via holes in said first grounded strip sections and said grounded surface, wherein one grounded strip section located on the left side of said microstrip input transmission line and the other grounded strip section symmetrically located on the right side of said transmission line; and a second grounded strip section, disposed in a third plane and positioned directly under and in parallel to said first grounded strip sections in said first plane, said second grounded strip section being connected to said grounded surface In said second plane through a plurality of corresponding via holes in said second grounded strip section and arounded surface.

2. The antenna of claim 1, wherein said bottom of said triangular-shaped resonant element comprises a bottom side that is parallel to said top side.

3. The antenna of claim 1, further comprising a pair of grounded strip sections, disposed in said first plane and in parallel to said rectangular strip load, each connected to a grounded surface in a second plane through a plurality of via holes, wherein one grounded strip section is located on the left side of said tapered strip section and the other grounded strip section is symmetrically located on the right side of said tapered strip section.

4. The antenna of claim 3, further comprising a dielectric medium positioned between said first and second planes, wherein said dielectric medium supports said triangular-shaped resonant element, said tapered strip section, said microstrip input transmission line, said rectangular strip load and said grounded strips on said first plane, and said grounded surface on said second plane.

5. The antenna of claim 4, wherein the dielectric medium is a printed circuit board, and wherein said triangular-shaped resonant element, said tapered strip section, said microstrip input transmission line, said rectangular strip load and said grounded strips in said first plane, and said grounded surface in said second plane are all metallic conductors printed on said circuit board.

6. The antenna of claim 1, wherein said pair of first grounded strip sections in said first plane provides a grounding platform for a first electromagnetic shielding cover disposed over said first plane of said antenna, and wherein said second grounded strip section in said third plane provides a grounding platform for a second electromagnetic shielding cover disposed over said third plane of said antenna.

7. The antenna of claim 6, wherein said the top surface of said first electromagnetic shielding cover comprises a rectangular hole which is used as the channel where said microstrip transmission line is connected to said tapering strip section.

8. The antenna of claim 7 further comprising:

a first dielectric medium positioned between said first and second planes;

a second dielectric medium positioned between said second and third planes; and wherein said first dielectric medium supports said triangular-shaped resonant element, said tapered strip section, said microstrip input transmission line, said rectangular strip load and said first grounded strips on said first plane, and said grounded surface on said second plane, and wherein said second dielectric medium supports said grounded surface on said second plane and said second grounded strip on said third plane.

9. The antenna of claim 8, wherein said first and second dielectric mediums comprise a portion of a printed circuit board, and wherein said triangular-shaped resonant element, said tapered strip section, said microstrip input transmission line, said rectangular strip load and said first grounded strips in said first plane, said grounded surface in said second plane, and said second grounded strip in said third plane are all metallic conductors printed on said circuit board.

10. The antenna of claim 1, wherein said antenna receives and transmits electromagnetic signals for a mobile communications device.

* * * * *